United States Patent [19]

Shirley

[11] 4,304,341

[45] Dec. 8, 1981

[54] REFRIGERATED DISPENSING UNIT

[76] Inventor: William C. Shirley, North Hudson, Wis.

[21] Appl. No.: 156,912

[22] Filed: Jun. 6, 1980

[51] Int. Cl.[3] ..... B67D 5/60; B67D 5/62

[52] U.S. Cl. ..... 222/131; 222/183; 222/146 C; 220/465; 312/296

[58] Field of Search ..... 220/465, 467; 312/296; 222/131, 183, 146 C, 146 R, 143, 129; 277/152

[56] References Cited

U.S. PATENT DOCUMENTS 3,233,817 2/1966 Casady ..... 220/465 X 3,237,810 3/1966 Gran ..... 222/146 C 3,435,990 4/1969 Pike, Jr. ..... 222/183 X 4,174,051 11/1979 Edwards et al. ..... 222/183 X

*Primary Examiner*—David A. Scherbel

*Attorney, Agent, or Firm*—Mark W. Gehan

[57] ABSTRACT

A refrigerated dispensing unit is disclosed comprising a cabinet which is adapted to receive a container of the type having a dispensing valve projecting outwardly for dispensing liquid from the container. The door enclosing the cabinet is pivotally mounted and has one or more apertures therein including a deformable gasket to receive and releasably engage the dispensing valve on the container when the door is closed.

6 Claims, 5 Drawing Figures

REFRIGERATED DISPENSING UNIT

TECHNICAL FIELD

This invention relates to refrigerated dispensing apparatus. More particularly, it relates to apparatus which is capable of dispensing liquids from a bulk container located inside such apparatus.

BACKGROUND OF THE INVENTION

In recent years wine has been a very popular drink, both at home and in restaurants and night clubs. The conventional mode for packaging such wines has been in glass bottles. However, this mode of packaging becomes costly when a restaurant must purchase and dispense a significant quantity of wine. Also, the inconvenience associated with disposing of large numbers of empty wine bottles becomes significant.

Recently some of these problems have been alleviated with the advent of "bag-in-box" wine containers in which wine is packaged in a plastic bag which is supported by a cardboard box. The plastic bag has a dispensing valve as an integral part of the bag and it projects outwardly through an aperture in the box. Although this type of wine packaging has alleviated some of the problems associated with packaging of wine in bottles, the use of such "bag-in-box" packages has not provided any means for refrigerating the wine.

Recently a refrigerated wine dispenser has become available from Vintner's Service Systems in which the "bag-in-box" wine containers may be placed, with the dispensing valve of the bag projecting through a slotted, removable panel in the door of the unit. However, in order to open the door of the unit to remove an empty container and replace it with a fresh container it is necessary to first slide the panel in the door upwardly to disengage the slotted panel from the dispensing valve and the door. After placing a fresh container in the unit and closing the door it is necessary to replace the slotted panel by sliding it downwardly over the dispensing valve projecting through the door. This necessity for removing the slotted panel when unloading the unit and replacing it when a fresh container is loaded into the unit is cumbersome and requires proper alignment of the slotted panel with the dispensing valve.

SUMMARY OF THE INVENTION

In accordance with the present invention there is provided a refrigerated dispensing unit which comprises a refrigerated cabinet which is adapted to receive a container of the type having a dispensing valve projecting outwardly for dispensing liquid from the container. The cabinet has a door which normally encloses the cabinet, and the door is pivotally mounted so as to be movable between its normally closed position and an open position so as to permit the container to be removed from the cabinet and replaced with a fresh container. The door has an aperture therein which includes a deformable gasket which is adapted to receive, and releasably engage, the dispensing valve on the container when the door is moved from its open position to its normally closed position.

In a preferred embodiment the refrigerated cabinet is adapted to receive a plurality of containers, and the door has a plurality of apertures therein corresponding to the number of containers.

The refrigerated dispensing unit of this invention is especially adapted to hold the "bag-in-box" containers and maintain the temperature of the liquid contents at a controlled level and yet permit the liquid to be dispensed at will without having to open the cabinet. Also, because of the provision of apertures having deformable gaskets in the door, the cabinet may be easily loaded with full containers; when the door is moved to its normally closed position the apertures permit the dispensing valves to project through the door, and the deformable gaskets closely engage the dispensing valves so as to prevent the chilled air in the refrigerated cabinet from exiting through the apertures.

BRIEF DESCRIPTION OF THE DRAWINGS

The invention is illustrated in more detail by reference to the accompanying drawings wherein like reference characters refer to the same parts throughout the several views and in which.

DETAILED DESCRIPTION OF THE INVENTION

Figure 1:
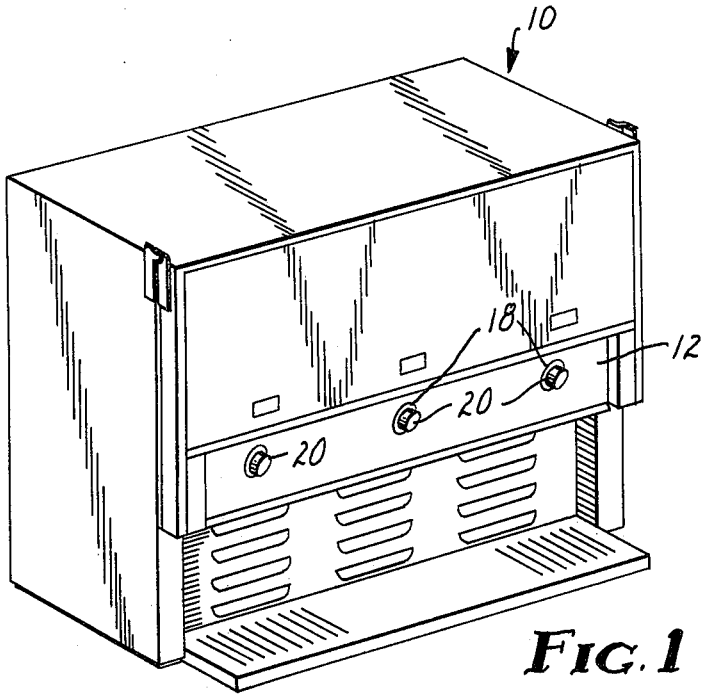
FIG. 1 is a perspective view of the apparatus of the invention.
Figure 2:
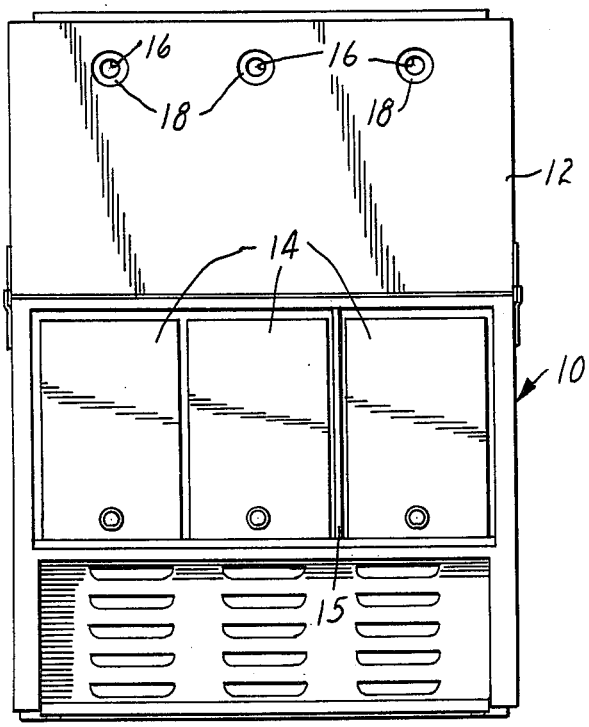
FIG. 2 is a front view of the apparatus of FIG. 1 with the door open.
Figure 3:
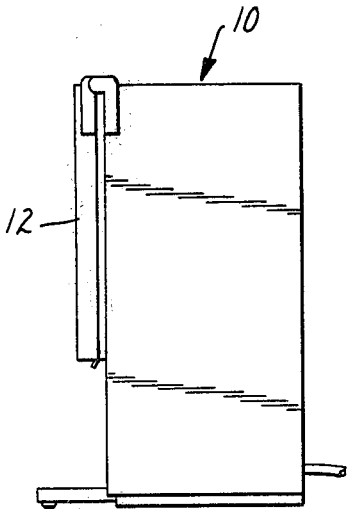
FIG. 3 is a side view of the apparatus of FIG. 1.
Figure 4:
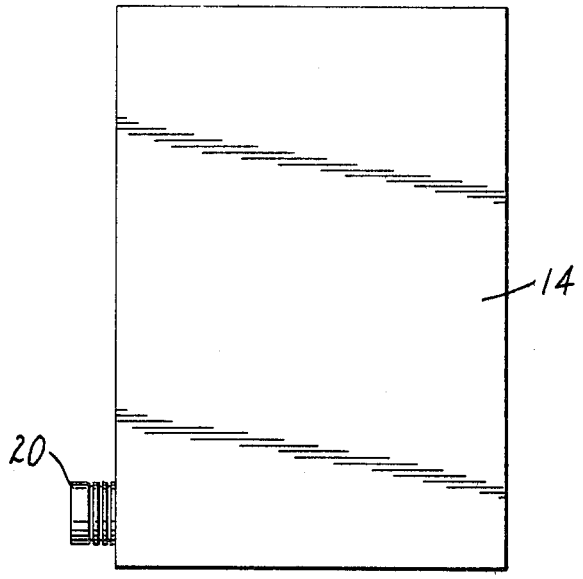
FIG. 4 is a side view of a dispensing valve on a container of the type shown in FIG. 2.

Thus, in the drawings there is shown a refrigerated cabinet 10 which may be, for example, rectangular in shape. Door 12 is preferably hinged at the top of cabinet 10 and is movable between its normally closed position (as shown in FIGS. 1 and 3) and an open position (as shown in FIG. 2). Such structure permits the cabinet to be readily re-loaded with fresh containers 14 when necessary. Conventional refrigerating apparatus (not shown) is contained in the lower portion of the cabinet 10 and is capable of maintaining the temperature of the contents at an adjustable, desired level compatible with the product being dispensed.

Preferably the refrigeration system is adapted to cool one side of the cabinet more than the other side so that, with the aid of a removable insulated partition 15, a sufficient temperature differential may be maintained between the two separated portions of the cabinet to satisfactorily cool certain types of wine to a given temperature in one portion of the cabinet while maintaining the air in the other portion of the cabinet at a warmer temperature for a different type of wine. When partition 15 is removed, the refrigeration system maintains a uniform temperature throughout the inside of the cabinet. Although the drawing shows the use of a partition in a dispensing unit having three containers therein, such a partition could also be used in a dispensing unit containing only two containers, for example. More than one partition could be used, if desired, in dispensing units having three, or more, containers therein.

The door 12 is provided with one or more apertures 16 corresponding to the number of containers 14 which are intended to be placed in cabinet 10. Each aperture 16 includes a gasket or ring 18 which is made of a deformable and resilient material such as commercially available neoprene or any other known material which retains its resiliency at reduced temperature and which has sufficient integrity to withstand continued flexing and cleaning.

Figure 5:
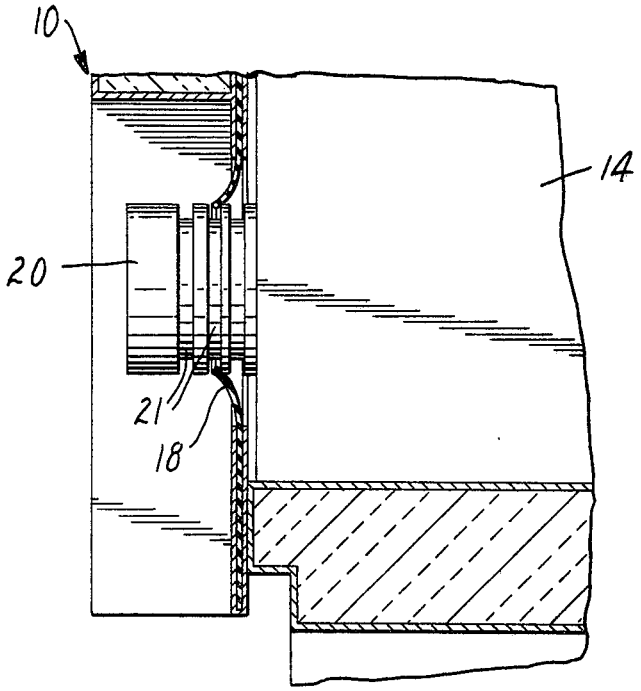
FIG. 5 shows the manner in which the dispensing valve projects through an aperture in the door of the unit, and how the gasket closely engages the dispensing valve.

When the door 12 is moved from its open position to its closed position each aperture 16 passes over the dispensing valve 20 on a respective container 14, and gasket 18 yields so as to permit the dispensing valve 20 to pass therethrough. The gasket 18 is sufficiently resilient that it closely engages dispensing valve 20 to inhibit or restrict flow of chilled air inside cabinet 10 through aperture 16. This is shown in FIGS. 1 and 5. Preferably, dispensing valve 20 has a number of circumferential grooves 21 thereon into which the gasket 18 may fit when the door 12 is in its normally closed position.

Thus, there is no need to employ complicated dispensing valves in the apparatus of this invention. Rather, the dispensing valve already present on the individual containers is used for dispensing purposes. Also, after the containers are loaded into the cabinet, it is necessary only to move the door to its closed position. The dispensing valves on the containers will automatically project outwardly through the apertures as the door is closed, and the gasket will self-seal around the dispensing valves. The door may be held in its normally closed position by any conventional means such as, for example, magnetic inserts in the frame of the cabinet.

It will be readily apparent to those skilled in the art that other variants are possible without departing from the scope of this invention.

What is claimed is:

1. A refrigerated dispensing unit comprising a refrigerated cabinet which is adapted to receive a container of the type having a dispensing valve projecting outwardly therefrom for dispensing liquid from said container, said cabinet having a door normally enclosing said cabinet, said door being pivotally mounted so as to be movable between its normally closed position and an open position so as to permit said container to be removed from said cabinet and replaced with a fresh container, said door having an aperture therein including a deformable gasket which is adapted to receive and releasably engage said dispensing valve on said container when said door is moved to its normally closed position, wherein said valve projects through said gasket when said door is in said closed position.

2. A refrigerated dispensing unit in accordance with claim 1, wherein said gasket comprises neoprene.

3. A refrigerated dispensing unit in accordance with claim 1, wherein said cabinet is adapted to receive a plurality of said containers.

4. A refrigerated dispensing unit in accordance with claim 3, wherein said door has a plurality of said apertures, corresponding to the number of said containers, which are adapted to receive and releasably engage a corresponding plurality of dispensing valves on said containers.

5. A refrigerated dispensing unit in accordance with claim 1, wherein said door comprises the front of said cabinet and is hinged at the top thereof.

6. A refrigerated dispensing unit comprising a refrigerated cabinet which is adapted to receive a container which comprises a plastic bag inside of a box, said plastic bag including a dispensing valve which projects outwardly through an aperture in said box, said cabinet having a door normally enclosing said cabinet, said door being pivotally mounted so as to be movable between its normally closed position and an open position so as to permit said container to be removed from said cabinet and replaced with a fresh container, said door having an aperture therein including a deformable gasket which is adapted to receive and releasably engage said dispensing valve on said container when said door is moved to its normally closed position, wherein said valve projects through said gasket when said door is in said closed position.

* * * * *